US006422536B1

(12) United States Patent
Kelley et al.

(10) Patent No.: US 6,422,536 B1
(45) Date of Patent: Jul. 23, 2002

(54) LIFTER APPARATUS FOR RAISING AND LOWERING A PART

(75) Inventors: Reginald D. Kelley, Lebanon; Michael J. Sharratt, Fairfield; Kenneth A. Baker, Hamilton, all of OH (US)

(73) Assignee: Force Control Industries, Inc., Fairfield, OH (US)

( * ) Notice: Subject to any disclaimer, the term of this patent is extended or adjusted under 35 U.S.C. 154(b) by 0 days.

(21) Appl. No.: 09/614,885

(22) Filed: Jul. 12, 2000

(51) Int. Cl.[7] ..... B66F 7/12

(52) U.S. Cl. ..... 254/89 R; 254/10 R; 254/90; 254/89 H; 254/124

(58) Field of Search ..... 254/89 R, 93 H, 254/93 R, 89 H, 10 R, 124, 9 R, 9 B, 9 C, 10 B, 8 R, 8 B, 8 C, 90

(56) References Cited

U.S. PATENT DOCUMENTS 4,324,386 A * 4/1982 Gagnon et al. ..... 254/288
4,938,321 A 7/1990 Kelley et al.
5,050,844 A * 9/1991 Hawk ..... 254/89 H
5,120,022 A * 6/1992 Kubik ..... 254/124
5,186,282 A * 2/1993 Everhard et al. ..... 254/124
5,199,686 A * 4/1993 Fletcher ..... 254/89 H
6,059,263 A * 5/2000 Otema et al. ..... 254/89 H

* cited by examiner

*Primary Examiner*—Joseph J. Hail, III
*Assistant Examiner*—Lee Wilson
(74) *Attorney, Agent, or Firm*—Jacox, Meckstroth & Jenkins

(57) ABSTRACT

A pair of horizontally spaced and horizontally extending part support rails or elongated platens are each guided and supported for vertical movement by a pair of guide and support members having linear bearing blocks mounted on vertical guide rails attached to corresponding vertical housings. A bell crank is pivotally supported adjacent each housing and is pivotally connected to the corresponding bearing block by a first link member. Second and third link members pivotally connect each pair of bell cranks for each platen to each other and to a crank arm mounted on a horizontal crankshaft extending laterally below the platens. A combined electric motor and gear reducer have an output shaft coupled to one end portion of the crankshaft, and an electric brake unit is connected to the motor shaft. An overtravel arm is also secured to the output shaft of the gear reducer and actuates an overtravel switch connected to control the electric motor. The output shaft also drives a programmable limit switch and feedback device for precisely controlling the electric motor and brake unit according to the position of the platens.

19 Claims, 1 Drawing Sheet

LIFTER APPARATUS FOR RAISING AND LOWERING A PART

BACKGROUND OF THE INVENTION

In the fabrication or assembly of articles or parts, the parts are commonly transferred along a production or assembly line by an endless transfer conveyor to a series of work stations where each part is worked on, for example, by welding the part and/or attaching another component to the part. For example, in the construction or assembly of a motor vehicle body, a succession of the car bodies are transferred in a step-by-step or continuous manner to a work station where it is necessary to elevate each body from the conveyor so that certain operations may be performed on the body at the elevated position. It is therefore necessary to have apparatus at the work station which can receive the horizontal conveyor and also raise the body to an elevated position for a, predetermined time, after which the body is lowered back onto the conveyor.

One apparatus which has been constructed and used for elevating a part, such as a vehicle body, from a conveyor at a work station is referred to as the DCT Acculift System which is manufactured by DCT Welding and Assembly in Detroit, Mich. This system incorporates two parallel spaced elongated rails or platens which are positioned adjacent opposite edge portions of the conveyor. Each elongated rail or platen is supported for vertical movement by a pair of horizontal tracks which receive linear bearing blocks pivotally connected to a pair of crank arms mounted on opposite end portions of a horizontal shaft extending parallel to the platen. The horizontal tracks are stabilized and maintained in horizontal positions during vertical movement by vertical linear bearings while the crank arms move the tracks and platens up and down between upper and lower predetermined positions. Each crankshaft for each platen is connected to a gear box, and the two gear boxes are connected by a cross drive shaft so that the crankshafts rotate in unison. One of the gear boxes has an input shaft coupled to the output shaft of a third gear box which is driven by an electric motor. Each of the parallel spaced crankshafts is provided with an overtravel arm which limits rotation of the crankshaft in one direction, and a mechanical counter-balancing system is used in association with the crank arm on each end of each crankshaft for counter-balancing the weight of the crank arm and the corresponding bearing block and track support arms.

SUMMARY OF THE INVENTION

The present invention is directed to an improved lifter apparatus of simplified and dependable construction and which requires only one gear reducer and eliminates the need for counter-balancing systems. The apparatus of the invention also provides for synchronized and harmonic movement of the lifting rails or platens and eliminates the need for horizontal linear bearings on the mechanism which supports and moves the rails or platens between their upper and lower positions. The lifter apparatus of the invention also has an overtravel arm mounted directly on the shaft of the drive for the apparatus so that components of the lifting mechanism are not over stressed in an overtravel condition.

In accordance with one embodiment of the invention, a lifter apparatus includes two parallel spaced elongated lift rails or platens each of which is guided for vertical movement by a pair of guide assemblies including linear bearing blocks mounted on corresponding vertical guide rails attached to vertical housings. A bell crank is pivotally supported adjacent each vertical guide assembly, and the two bell cranks for each lift platen are pivotally connected to the corresponding bearing blocks by first link members and to each other by a second link member. A third link member pivotally connects each set of bell cranks for each lift platen to a corresponding crank arm mounted on a crankshaft extending horizontally and laterally below the lift platens. A drive unit is connected to one end portion of the crankshaft and includes electric drive motor mounted on a gear reducer and also coupled to an electric brake unit. The output shaft of the gear reducer is coupled to the end portion of the crankshaft and also supports an overtravel arm which is adapted to actuate an overtravel switch. The output shaft of the gear reducer is also coupled to a programmable limit switch and feedback device having a cam switch and resolver or encoder to provide precision control of the electric drive motor and brake unit.

Other features and advantages of the invention will be apparent from the following description, the accompanying drawings and the appended claims.

DESCRIPTION OF THE PREFERRED EMBODIMENT

Figure 1:
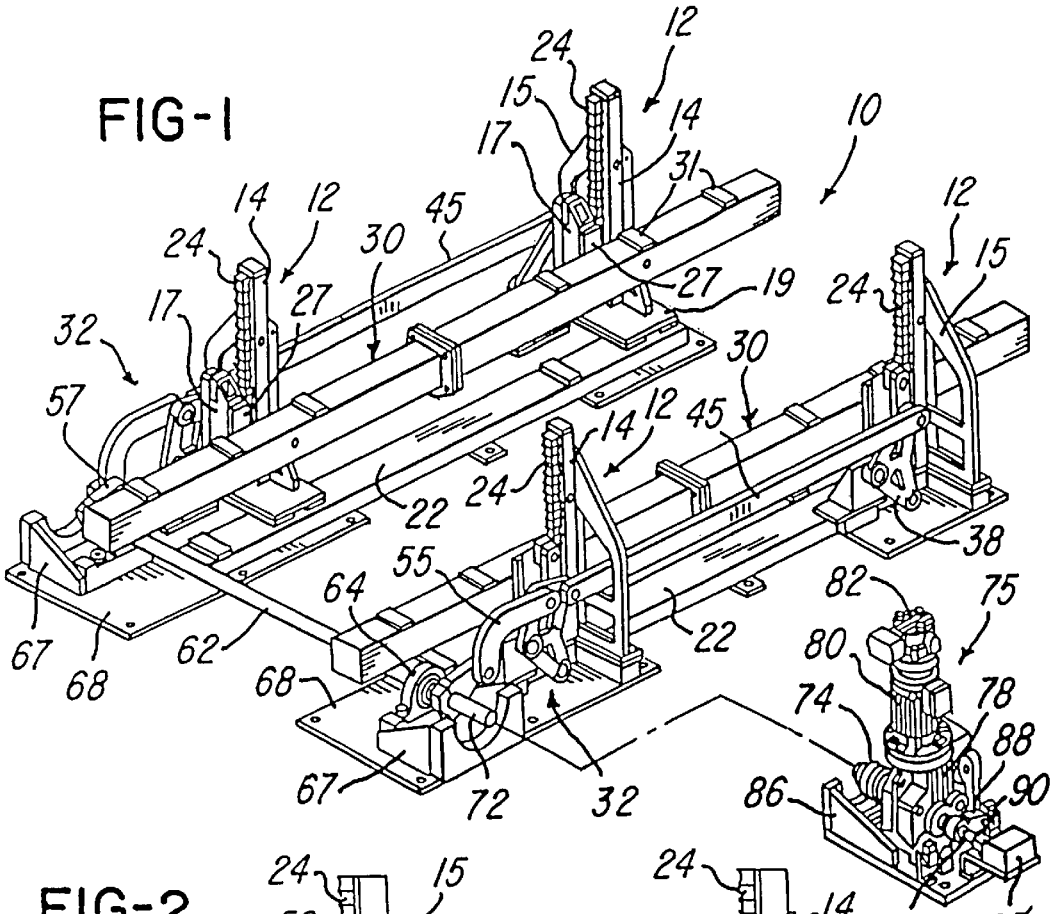
FIG. 1 is a perspective view of lifter apparatus constructed in accordance with the invention and showing the drive unit in an exploded position.

Referring to FIG. 1, a steel fabricated open center lifter apparatus 10 includes four vertical guide and support members 12 each of which includes a hollow steel column or housing 14 reinforced by gussets 15 and an attached vertical guide rail (not shown) on which is mounted a linear anti-friction bearing block 17 to provide for low friction vertical movement of each block 17. Each housing 14 is secured to a corresponding base plate 19, and a horizontal tubular beam 22 rigidly connects each pair of spaced support members 12. A pair of upper and lower collapsible bellows 24 are connected to each bearing block 17 and slidably connect with the corresponding housing 14 to provide protection for the vertical guide rod and linear bearings on the housing 14.

An L-shaped support bracket 27 is mounted on each bearing block 17, A and the brackets 27 for each pair of spaced support members 12 support an elongated horizontal rail or platen 30 each formed in two sections of square steel tubing joined end to end and having a series of tooling support pads 31 mounted on the top surface of the platen. As shown in FIG. 1, the two pairs of guide and support members 12 are spaced horizontally so that a substantial space is provided between the pair or parallel spaced horizontal platens 30 for receiving a conveyor system between the platens. As mentioned above, the conveyor system (not shown) may incorporate an endless belt or endless chains and be provided with fixtures for supporting a continuous series of large parts, for example, motor vehicle bodies. When a part arrives at the work station defined between the two pair of guide and support members 12, the pair of elongated rails or platens 30, having fixtures (not shown) mounted on the tooling pads 31, are elevated in unison by a predetermined distance for picking up and raising the part to an elevation where the part may be worked on, for example, by robotic welding equipment. After the work on the part is completed, the rails or platens 30 are lowered for returning the part back down to the conveyor where the part is received and advanced to the next work station.

The support and vertical movement of the parallel spaced rails or platens 30 between their normal lower retracted positions (FIG. 2) and elevated upper positions (FIG. 3) are provided by two actuating mechanisms 32 each of which includes a set of bell cranks 36 and 38 for each pair of guide and support members 12 and each support rail or platen 30. Each set of bell cranks 36 and 38 are pivotally supported by pivot pins or shafts 41 (FIG. 2) mounted on fabricated steel brackets 43 secured to the corresponding connecting beam 22. A generally horizontal elongated link member 45 pivotally connects each set of bell cranks 36 and 38 by pivot pins or shafts 47, and a generally vertical link member 49 (FIG. 3) pivotally connects each of the bell cranks 36 and 38 to the corresponding bearing block 17 by pivot pins or shafts 52.

Each of the bell cranks 36 is also connected by a generally L-shaped link member 55 to a corresponding crank arm 57 by corresponding pivot pins or shafts 58. The crank arms 57 are rigidly secured to opposite end portions of an elongated crankshaft 62 which extends horizontally below the horizontal rails or platens 30. The crankshaft 62 is supported for rotation by a pair of aligned bearing blocks 64 mounted on fabricated steel bearing support members 67 attached to corresponding rectangular base plates 68 extending under and secured to the connecting beams 22. The crankshaft 62 has a projecting end portion 72 (FIG. 1) connected by a coupling 74 to a drive unit 75 effective to rotate the crankshaft 62 in opposite directions and oscillate the crank arms 57 through an angle of about 180° (FIGS. 1 & 2).

The drive unit 75 includes a gear reducer 78 having an input shaft driven by the shaft of a reversible electric motor 80 coupled to the gear reducer 78 and on which is mounted an electrically actuated brake unit 82. Preferably the brake unit 82 is an oil shear brake constructed as disclosed in U.S. Pat. No. 4,938,321 which issued to the assignee of the present invention and the disclosure of which is incorporated herein by reference. As disclosed in the patent, the brake unit 82 has spring set discs and plates so that the brake is normally applied to the motor shaft when the brake unit is not energized.

The gear reducer 78 has an output shaft 84 which extends through the gear reducer and has one end portion connected by the coupling 74 to the end portion 72 of the crankshaft 62. The gear reducer 78 is mounted on and supported by a fabricated steel base 86, and an overtravel arm 88 is rigidly secured to the opposite end portion of the output shaft 84 for rotation with the shaft and the crankshaft 62. An overtravel bumper and switch 90 is engaged by the overtravel arm 88 and is connected to de-energize the motor 80 in the event the control of the electric motor 80 and brake unit 82 do not stop the motor shaft precisely at the desired rotation of the crankshaft 62. A rubber bumper (not shown) is also mounted on the base 86 to form a positive stop for the overtravel arm 88 in the lower position of the support rails or platens 30 (FIG. 2). The output shaft of the gear reducer 78 is also connected to drive a programmable limit switch and feedback device 95 constructed in accordance with the disclosure of pending U.S. patent application Ser. No. 09/104,023, filed Jun. 24, 1998, the disclosure of which is incorporated by reference.

Figure 2:
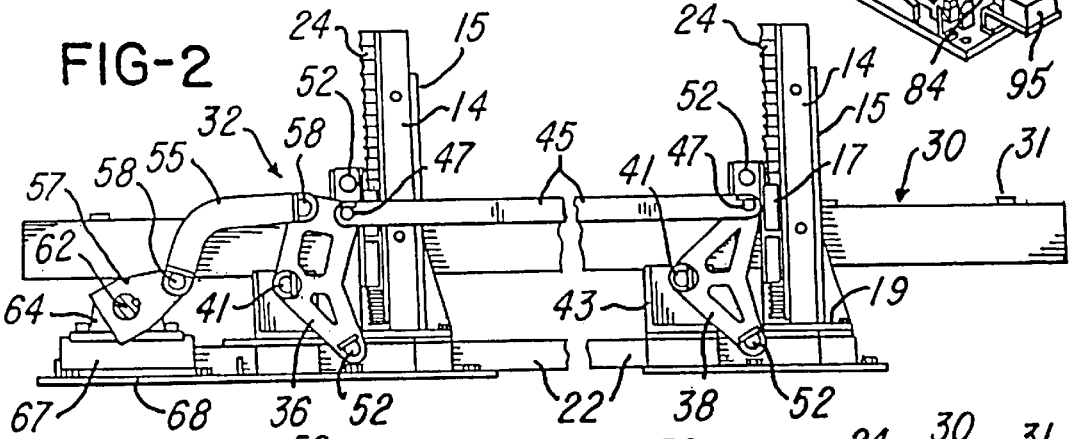
FIG. 2 is a side view of the lifter apparatus shown in FIG. 1 without the drive unit and with the horizontal lifting platens in their lower position.
Figure 3:
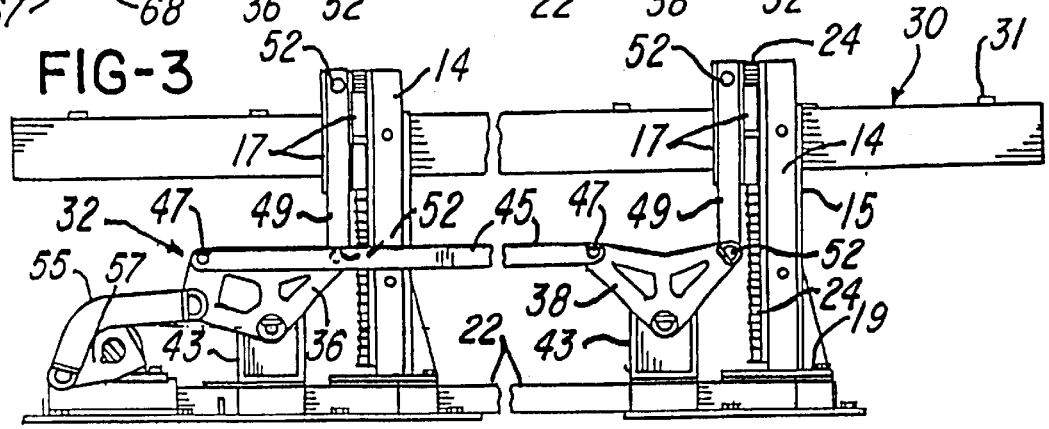
FIG. 3 is a side view similar to FIG. 2 and showing the lifting platens in their upper position.

When the crankshaft 62 is in the position shown in FIG. 2, the pair of elongated rails or platens 30 are in their lower position (FIG. 2) so that the part may be transferred to the lifter apparatus 10 and above the platens and its attached fixtures by the endless conveyor extending between the platens 30. When the part arrives at the work station having the lifter apparatus 10, the reversible electric drive motor 80 is energized so that the gear reducer 78 rotates the crankshaft 62 in a counter-clockwise direction through approximately 180° to the position shown in FIG. 3 where the platens 30 are elevated to their upper position for raising the part to an elevated position where the part is worked on in some manner. After the work on the part is completed, the motor 80 is energized for rotation of the motor shaft in the opposite direction for rotating the crankshaft 62 clockwise back to the position shown in FIG. 2 so that the part is lowered and transferred back to the conveyor for advancement to the next work station.

From the drawings and the above description, it is apparent that lifter apparatus constructed in accordance with the present invention provides desirable features and advantages. For example, the rotation of the crank arms 57 with the crankshaft 62 through an angle of about 180° produces simultaneous rotation of the pair of bell cranks 36 and the pair of bell cranks 38 for generating harmonic vertical movement of the support rails or platens 30 guided by the bearing blocks 17. The slow or soft start and stop of the platens 30 and the supporting part during the vertical movement, results in positioning the platens and the part with high accuracy at the upper and lower positions. This results in higher quality operations being performed on the part at the work station. The crank mechanism of the apparatus 10 is also simple in construction and durable in operation to provide the apparatus with an extended service life, and no counter-balancing system is required. The crank mechanism 32 also requires only one gear reducer 78, and the overtravel arm 88 is mounted on the gear reducer shaft so that no overloading stresses are produced in the crank mechanism 32. Since both of the crank arms 57 are mounted on a common crankshaft 62, the up and down movement of the platens 30 is precisely synchronized, While the form of lifter apparatus herein described constitutes a preferred embodiment of the invention, it is to be understood that the invention is not limited to this precise form of apparatus, and that changes may be made therein without departing from the scope and spirit of the invention as defined in the appended claims.

What is claimed is:

1. Apparatus for raising and lowering a part between a lower position and an upper position, said apparatus comprising horizontally spaced platens adapted to receive the part from a conveyor extending between the platens, a set of guide members supporting said platens for generally vertical movement between said lower position and said upper position, each of said guide members including a linear bearing member connected to one of said platens and supported by a generally vertical guide rail, a generally horizontal crankshaft extending below said platens and between said guide members, a set of crank arms mounted on said crankshaft, at least one pivotally supported bell crank member for each of said crank arms, a first link member pivotally connecting each of said crank arms to the corresponding said bell crank member, a second link member pivotally connecting each of said bell crank members to the corresponding said platen, and a power operated reversible drive connected to rotate one end portion of said crankshaft in opposite directions to provide smooth harmonic vertical movement of said platens and the part between said upper and lower positions.

2. Apparatus as defined in claim 1 wherein said platens are elongated and extend generally horizontally in generally parallel spaced relation, a set of horizontally spaced said guide members supporting each of said platens for vertical movement, a corresponding set of said bell crank members for each of said platens, and a third link member pivotally connecting each set of said bell crank members to provide for oscillation of all of said bell crank members in unison.

3. Apparatus as defined in claim 1 wherein said power operated drive comprises a reversible electric drive motor having a motor shaft connected to a gear reducer having an output shaft connected to said end portion of said crankshaft, and a power operated brake unit connected to said electric motor shaft.

4. Apparatus as defined in claim 3 and including a programmable limit switch and feedback controller driven by said output shaft of said gear reducer for controlling the operation of said drive motor.

5. Apparatus as defined in claim 3 and including an overtravel arm mounted on said output shaft of said gear reducer, and an overtravel control switch for said motor and positioned to be actuated by said overtravel arm.

6. Apparatus as defined in claim 3 wherein said brake unit comprises a housing enclosing a stack of oil shear brake discs and plates, and springs normally urging said stack of brake discs and plates together for stopping said motor shaft.

7. Apparatus as defined in claim 1 wherein each of said guide members comprises a generally vertical housing enclosing the corresponding said guide rail, and a flexible bellows supported by each said housing and connected to the corresponding said bearing member.

8. Apparatus for raising and lowering a part between a lower position and an upper position, said apparatus comprising generally parallel spaced and generally horizontal elongated platens adapted to receive the part from a conveyor extending between the platens, a set of guide members supporting each of said platens for generally vertical movement between said lower position and said upper position, a generally horizontal crankshaft extending below said platens and between said sets of guide members, a crank arm mounted on said crankshaft for each said set of guide members, a set of pivotally supported bell crank member for each of said crank arms, a first link member pivotally connecting each of said crank arms to one of said bell crank members of the corresponding said set of bell crank members, a second link member pivotally connecting said bell crank members of each said set, a third link member connecting each of said bell crank members to the corresponding said platen, and a power operated reversible drive connected to rotate one end portion of said crankshaft in opposite directions to provide smooth harmonic vertical movement of said platens and the part between said upper and lower positions.

9. Apparatus as defined in claim 8 wherein said power operated drive comprises a reversible electric drive motor having a motor shaft connected to a gear reducer having an output shaft connected to said end portion of said crankshaft, and a power operated brake unit connected to said electric motor shaft.

10. Apparatus as defined in claim 9 and including an overtravel arm mounted on said output shaft of said gear reducer, and an overtravel bumper and control switch for said motor and positioned to be engaged by said overtravel arm.

11. Apparatus as defined in claim 9 and including a programmable limit switch and feedback controller driven by said output shaft of said gear reducer for controlling the operation of said drive motor.

12. Apparatus as defined in claim 9 wherein said brake unit comprises a housing enclosing a stack of oil shear brake discs and plates, and springs normally urging said stack of brake discs and plates together for stopping said motor shaft.

13. Apparatus as defined in claim 8 wherein each of said guide members comprises a linear bearing member connected to one of said platens and supported by a generally vertical guide rail.

14. Apparatus as defined in claim 13 wherein each of said guide members comprises a generally vertical housing enclosing the corresponding said guide rail, and a flexible bellows supported by each said housing and connected to the corresponding said bearing member.

15. Apparatus for raising and lowering a part between a lower position and an upper position, said apparatus comprising generally parallel spaced and generally horizontal elongated platens adapted to receive the part from a conveyor extending between the platens, a set of generally vertical guide members supporting opposite end portions of each of said platens for generally vertical movement between said lower position and said upper position, a generally horizontal crankshaft extending between said sets of guide members, a crank arm mounted on said crankshaft for each said set of guide members, a set of pivotally supported bell crank members for each of said crank arms, a first link member pivotally connecting each of said crank arms to one of said bell crank members of the corresponding said set of bell crank members, a second link member pivotally connecting said bell crank members of each said set, a third link member connecting each of said bell crank members to the corresponding said platen, a reversible electric motor and gear reducer drive having an output shaft connected to rotate one end portion of said crankshaft in opposite directions to provide smooth harmonic vertical movement of said platens and the part between said upper and lower positions, and an electrically actuated brake unit mounted on said motor and connected to stop a shaft of said motor.

16. Apparatus as defined in claim 15 and including an overtravel arm mounted on said output shaft of said drive, and an overtravel bumper and control switch for said motor and positioned to be engaged by said overtravel arm.

17. Apparatus as defined in claim 15 and including a programmable limit switch and feedback controller driven by said output shaft of said drive for controlling the operation of said motor.

18. Apparatus as defined in claim 15 wherein said brake unit comprises a housing enclosing a stack of oil shear brake discs and plates, and springs normally urging said stack of brake discs and plates together for stopping said motor shaft.

19. Apparatus as defined in claim 15 wherein each of said guide members comprises a linear bearing block connected to one of said platens and supported by a generally vertical guide rail, a generally vertical housing attaching the corresponding said guide rail, and a flexible bellows supported by each said housing and connected to the corresponding said bearing block.

* * * * *